US006058712A

United States Patent [19]

Rajasubramanian et al.

[11] Patent Number: 6,058,712

[45] **Date of Patent: *May 9, 2000**

[54] HYBRID AIR CONDITIONING SYSTEM AND A METHOD THEREFOR

[75] Inventors: Sathya Rajasubramanian, Arlington; Roger S. DeVilbiss, Dallas; Thomas C. Dedmon, Lewisville; Tony M. Quisenberry, Highland Village, all of Tex.

[73] Assignee: Thermotek, Inc., Carrollton, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/679,126

[22] Filed: Jul. 12, 1996

[51] Int. Cl.[7] ..... F25B 21/00; H05K 7/20

[52] U.S. Cl. ..... 62/3.6; 62/3.7; 361/697

[58] Field of Search ..... 62/3.2, 3.3, 3.6, 62/3.7, 259.2; 361/688, 689, 690, 691, 694, 695, 696, 697

[56] References Cited

U.S. PATENT DOCUMENTS

| | | | |
|---|---|---|---|
| 2,416,152 | 2/1947 | Braun | 165/185 |
| 2,713,655 | 7/1955 | Grubman | 165/185 |
| 3,040,538 | 6/1962 | Alsing | 62/3 |
| 3,087,309 | 4/1963 | Toulmin, Jr. | 62/3 |
| 3,226,602 | 12/1965 | Elfving | 62/3.3 |
| 4,290,273 | 9/1981 | Meckler | 62/148 |
| 4,301,658 | 11/1981 | Reed | 62/3.7 X |
| 4,306,613 | 12/1981 | Christopher | 165/32 |
| 4,328,677 | 5/1982 | Meckler | 62/124 |
| 4,347,474 | 8/1982 | Brooks et al. | 323/224 |

(List continued on next page.)

FOREIGN PATENT DOCUMENTS

| | | |
|---|---|---|
| 0 478 204 | 4/1992 | European Pat. Off. . |
| 37 30 830 | 3/1989 | Germany . |
| 4036210 | 5/1992 | Germany . |
| 57-138415 | 8/1982 | Japan . |
| 0188855 | 11/1982 | Japan . |
| 7-106640 | 4/1995 | Japan . |
| 8-136422 | 5/1996 | Japan . |
| 2 174 792 | 11/1985 | United Kingdom . |
| 2 164 135 | 3/1986 | United Kingdom . |
| 2 250 337 | 6/1992 | United Kingdom . |
| 2 260 191 | 4/1993 | United Kingdom . |

OTHER PUBLICATIONS

Communication Relating to the Results of the Partial International Search for International application No. PCT/US97/12103, claiming priority to U.S. Application Ser. No. 08/679,126.

Office Action in 08/893,851, mailed Feb. 24, 1998.

*Primary Examiner*—William Doerrler

*Attorney, Agent, or Firm*—Jenkens & Gilchrist, P.C.

[57] ABSTRACT

A system for conditioning the air within an enclosure which houses heat producing equipment. The system includes a passive heat removal system, for precooling the air, and a thermoelectric temperature control system used in conjunction with the passive heat removal system to achieve the necessary temperature control. A power control system includes a programmable control means which receives signals, from a temperature sensor, which are indicative of the temperature of the air in the enclosure. Based upon these signals, the power control system controls the activation of thermoelectric devices in the thermoelectric temperature control system and controls the activation of fans to remove a desired amount of heat from the air in the enclosure and discharge the unwanted heat to the outside air. A switching device operates to apply battery power to the power control system if the electrical power source for the thermoelectric temperature control system fails. A polarity reversal circuit reverses the DC polarity of the DC voltage applied to the thermoelectric devices to reverse the heat pumping of the thermoelectric devices in the situation where the air in the enclosure needs to be heated.

42 Claims, 2 Drawing Sheets

U.S. PATENT DOCUMENTS

| | | | |
|---|---|---|---|
| 4,449,576 | 5/1984 | Baum et al. | 165/104.33 |
| 4,463,569 | 8/1984 | McLarty | 62/3 |
| 4,478,277 | 10/1984 | Friedman et al. | 165/185 |
| 4,490,982 | 1/1985 | Christmas | 62/3 |
| 4,631,728 | 12/1986 | Simons | 372/38 |
| 4,685,081 | 8/1987 | Richman | 365/1 |
| 4,709,323 | 11/1987 | Lien | 363/97 |
| 5,035,052 | 7/1991 | Suzuki et al. | 29/890.046 |
| 5,079,618 | 1/1992 | Farnworth | 357/81 |
| 5,097,829 | 3/1992 | Quisenberry | 128/400 |
| 5,128,517 | 7/1992 | Bailey et al. | 219/506 |
| 5,172,689 | 12/1992 | Wright | 128/400 |
| 5,174,121 | 12/1992 | Miller | 62/3.7 |
| 5,190,032 | 3/1993 | Zacol | 128/400 |
| 5,197,291 | 3/1993 | Levinson | 62/3.2 |
| 5,197,294 | 3/1993 | Galvan et al. | 62/3.62 |
| 5,279,128 | 1/1994 | Tomatsu et al. | 62/3.4 |
| 5,315,830 | 5/1994 | Doke et al. | 62/3.2 |
| 5,371,665 | 12/1994 | Quisenberry et al. | 363/89 |
| 5,450,727 | 9/1995 | Ramirez et al. | 62/3.7 |
| 5,505,046 | 4/1996 | Nelson et al. | 62/3.6 |
| 5,528,485 | 6/1996 | DeVilbiss et al. | 363/89 |
| 5,561,981 | 10/1996 | Quisenberry et al. . | |
| 5,588,300 | 12/1996 | Larsson et al. | 62/3.61 |

HYBRID AIR CONDITIONING SYSTEM AND A METHOD THEREFOR

BACKGROUND OF THE INVENTION

1. Field of the Invention

The present invention relates to air conditioning systems, and more particularly, but not by way of limitation, to a passive heat removal system in conjunction with a thermoelectric temperature control system for conditioning the air in an enclosure which shelters heat producing equipment such as a microwave repeater station or other electronic equipment housed in a remote location.

2. History of the Prior Art

Heat producing equipment such as, for example, remote microwave repeater stations or remote cell sites for cellular phone systems, are frequently subjected to very high ambient temperatures which may have an adverse affect on the life, reliability and/or performance of the equipment. Several systems are available for the cooling or conditioning of the air in the electronic enclosures. The technology used for cooling relate to and include passive cooling systems, conventional compressor-based systems and thermoelectric systems.

In passive cooling systems, the air to be cooled is circulated over an air-to-air heat exchanger, which includes folded, finned heat exchangers, heat pipes, etc. The heat is then exchanged with the outside ambient air. As the amount of heat to be removed from the enclosure increases, the size of the air-to-air heat exchanger must be increased in size, which may be a drawback. Another drawback of the passive cooling system is that the amount of heat the system can remove from the enclosure is determined by the ambient temperatures of the air surrounding the enclosure. Therefore, if the ambient temperature is at, for example, 55° C., the temperature inside the enclosure can only be lowered to a temperature slightly above the ambient temperature by the passive cooling system.

Compressor based systems function by using a refrigerant and the cooling function is achieved by the compression and expansion of the refrigerant. The compressor based systems are efficient but are bulky, have large maintenance costs and consume large amounts of electricity. Also, all the cooling is done actively, which may not be necessary when, for example, the ambient outside air is sufficiently cool.

Thermoelectric temperature control systems use thermoelectric devices that pump heat using the Peltier effect. The thermoelectric devices are highly reliable and very economical at low wattage applications. As the number of watts to be removed are increased, the cost of this type of system increases as the cost is directly related to the number of thermoelectric devices that are needed for the particular function. The cooling capacity may be limited because of the power supply requirements since more thermoelectric devices necessitates more power.

The most typical thermoelectric device incorporates a thermoelectric module/component that utilizes electrical current to absorb heat from one side of the module and dissipate that heat on the opposite side. If the current direction is reversed, so is the heat pumping. Generally, cold sides and hot sides are developed necessitating an effective means of removing or adding heat from or to a solid, liquid or a gas (typically air).

It would be advantageous to provide a system which would condition the air in the electronic enclosures in an improved manner which would be low cost, reliable, efficient and low maintenance. The present invention provides such an improvement over the prior art by eliminating the need for refrigerant while providing high energy efficiency with improved cooling capacity, low maintenance, low cost, and low noise, and which is light weight and compact.

SUMMARY OF THE INVENTION

The present invention relates to a method of and apparatus for a hybrid air conditioning system. More particularly, one aspect of the present invention comprises a low cost passive heat removal system in conjunction with a thermoelectric temperature control system. The passive heat removal system precools the air prior to the thermoelectric temperature control system, which performs the subsequent cooling and temperature control, if needed, of the air in an enclosure which houses the heat producing equipment. The thermoelectric temperature control system is operated only when needed which results in a large energy cost savings. Another aspect of the present invention comprises a power control system which includes a programmable control means to receive signals, from a temperature sensor, which are indicative of the temperature of the air in the enclosure which houses heat producing equipment. Based upon these signals, the power control system controls the activation of the thermoelectric devices and fans to remove a desired amount of heat from the air in the enclosure and discharge the unwanted heat to the outside air. The programmable control means comprises a microprocessor and associated software.

Another aspect of the present invention comprises a switching device operatively connected between an electrical power source in the enclosure which houses heat producing equipment and a power control system. The switching device operates to apply battery power to the power control system if the electrical power source fails.

Another aspect of the present invention comprises a polarity reversal circuit operatively connected between the power control system and the thermoelectric devices to reverse the heat pumping of the thermoelectric devices in the situation where the air in the enclosure housing the heat producing equipment needs to be heated.

Another aspect of the invention comprises a method of conditioning air in a process which utilizes the apparatus described above.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DETAILED DESCRIPTION

Figure 1:
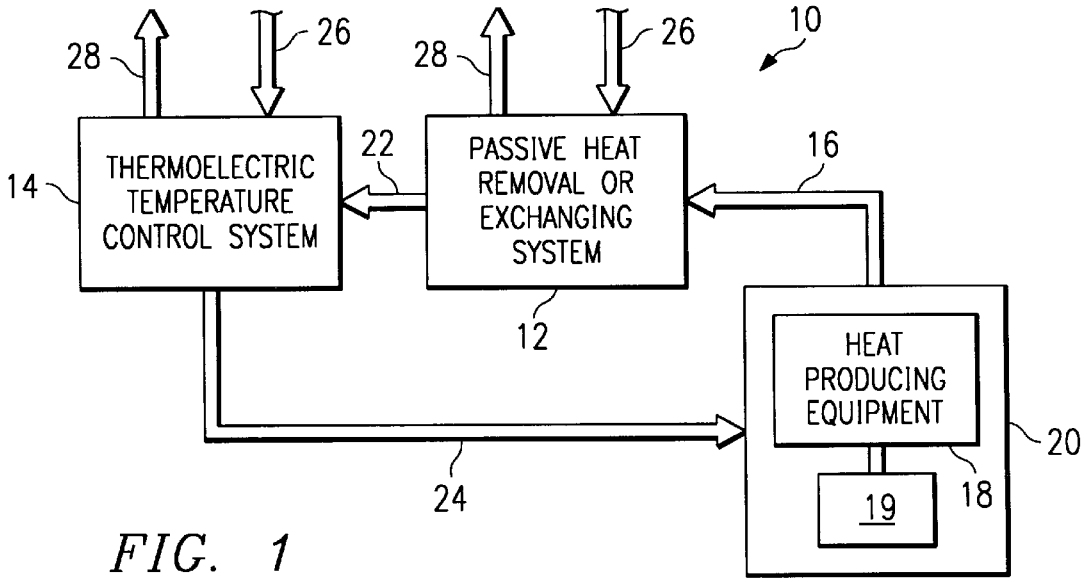
FIG. 1 is a block diagram showing the air flow between the present invention and the heat producing equipment.

Referring now to the drawings, and in particular to FIG. 1, the hybrid air conditioning system according to the present invention is referred to generally by reference numeral 10. Hybrid air conditioning system 10 comprises a passive heat removal or exchanging system 12 and a thermoelectric temperature control system 14. The warm or heated air 16, which is heated by the heat producing equipment 18 located in enclosure 20 and powered by a DC voltage from electrical power source 19, flows through and over the passive heat removal or exchanging system 12 where the warm or heated air 16 is precooled. The precooled air 22 then flows through and over the thermoelectric temperature control system 14. If the temperature of the precooled air 22 has not been reduced to the required temperature, the thermoelectric temperature control system 14 is activated and reduces or further cools the temperature of the precooled air 22 down to the required temperature. The cooled air 24, which has been cooled down to the required temperature, is sent back to enclosure 20. Ambient air 26 is drawn into both the passive heat removal or exchanging system 12 and the thermoelectric temperature control system 14 to assist in the heat removal process and is warmed and then the warmed ambient air 28 is exhausted back to the outside air. Neither the ambient air 26 or the warmed ambient air 28 is mixed with either the precooled air 22 or the cooled air 24. It will be appreciated that if the passive heat removal or exchanging system 12 is able to cool the warm or heated air 16 down to the required temperature, then the thermoelectric temperature control system 14 is not activated and is in a passive state for the cooling process.

Figure 2:
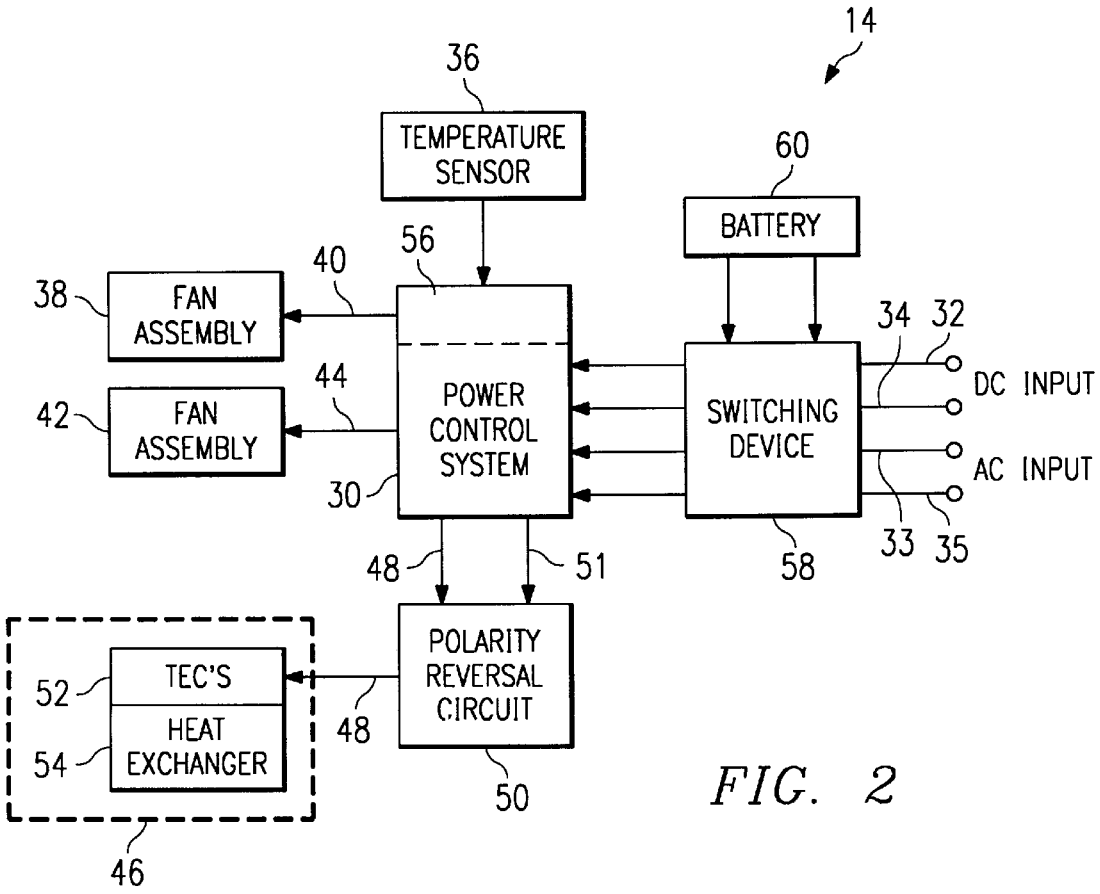
FIG. 2 is an electrical diagram of the thermoelectric temperature control system of the present invention.

Referring now to FIG. 2, the thermoelectric temperature control system 14 comprises a power control system 30 which receives input power, a DC voltage on leads 32 and 34 and an AC voltage on leads 33 and 35, from the electrical power source 19 in enclosure 20. Power control system 30 receives an input from temperature sensor 36, located in enclosure 20, which is indicative of the temperature of the air in enclosure 20. Power control system 30 provides the power and control thereof to fan assembly 38 via leads or cable 40 and also provides the power and control thereof to fan assembly 42 via leads or cable 44. It will be appreciated that each fan assembly can be controlled separately so that both fan assemblies can be on at the same time, both fan assemblies can be off at the same time and each fan assembly can be on at different times. Fan assembly 38 provides movement of the air, in enclosure 20, through a portion or section of the passive heat exchanging system 12, a portion or section of the thermoelectric temperature control system 14 and the enclosure 20 and will be shown in more detail in the discussion of FIG. 3. Fan assembly 42 provides movement of the ambient or outside air through a different portion or section of the passive heat exchanging system 12 and a different portion or section of the thermoelectric temperature control system 14 and will be shown in more detail in the discussion of FIG. 3.

Power control system 30 also provides the power and control thereof to thermoelectric assembly 46 via leads or cable 48 which passes through polarity reversal circuit 50. Polarity reversal circuit 50 reverses the polarity of the DC voltage applied to the thermoelectric assembly 46 if it is desired for the thermoelectric assembly 46 to provide heating rather that cooling. The position or state of the polarity reversal circuit 50 is determined and controlled by the signal sent from the power control system 30 via lead 51. Thermoelectric assembly 46 comprises thermoelectric devices 52 operatively mounted to heat exchanger 54. Power control system 30 comprises programmable control means 56 which receives the output from temperature sensor 36 and causes the power control system 30 to activate thermoelectric assembly 46 when needed. Programmable control means 56 comprises a microprocessor and associated software.

Power control system 30 can be one of two different designs which are available and will perform the necessary functions in the present invention. One design which can be used is that of the power control circuitry constructed in accordance with the teachings of U.S. Pat. No. 5,371,665, incorporated herein by reference. Another design which can be used is that of the current control circuit constructed in accordance with the teachings of U.S. patent application entitled "Current Control Circuit For Improved Power Application and Control of Thermoelectric Devices" filed 02/27196 with Ser. No. 08/607,713 incorporated herein by reference.

As previously mentioned, power control system 30 receives a DC voltage on leads 32 and 34 which pass through switching device 58. Also connected to switching device 58 is battery 60. In the preferred embodiment, switching device 58 can be a normally open relay operatively connected such that if the DC power from the electrical power source 19 fails then switching device 58 will connect battery 60 to power control system 30 so the thermoelectric temperature control system 14 will remain operable if the operation thereof is required. In the preferred embodiment, battery 60 will be either 24 volt DC or 48 volt DC.

Figure 3:
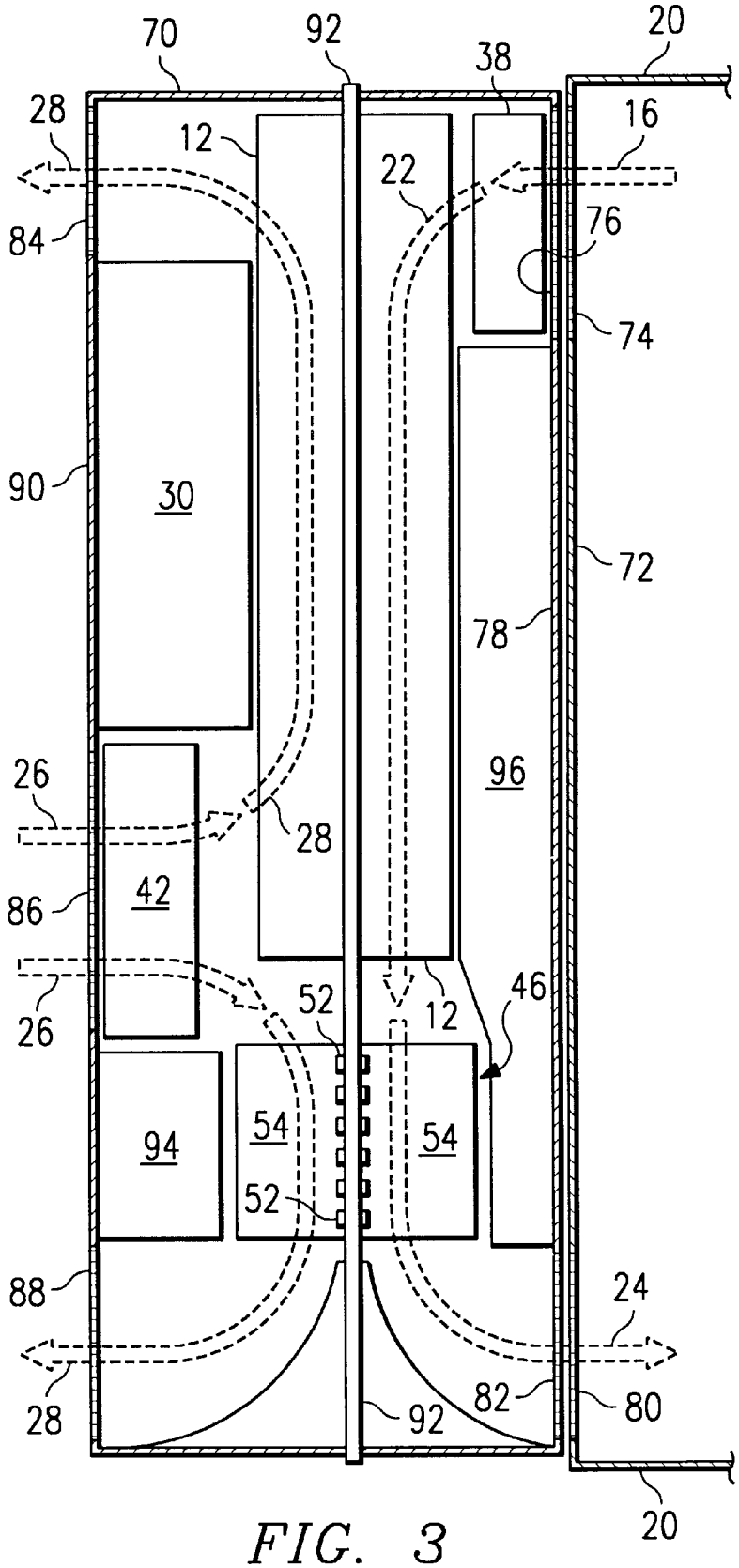
FIG. 3 is a side elevational view of the present invention mounted within a housing, with the side panel removed for viewing the elements, and with the housing installed against the enclosure which shelters the heat producing equipment.

Referring now to FIG. 3, the present invention is shown mounted in housing 70 with housing 70 being attached to or coupled to wall 72 of enclosure 20. Opening 74 is formed in wall 72 to align with opening 76 in wall 78 of housing 70. Opening 80 is formed in wall 72 of enclosure 20 to align with opening 82 in wall 78 of housing 70. Openings 84, 86 and 88 are formed in wall 90 of housing 70. Fan assembly 38 is operatively positioned with respect to openings 74 and 76 to draw air therethrough from enclosure 20 and to discharge air back into enclosure 20 through openings 82 and 80. Fan assembly 38 will include at least one fan. Fan assembly 42 is operatively positioned with respect to opening 86 to draw outside ambient air 26 therethrough and to discharge the air back outside through openings 84 and 88. Fan assembly 42 will include at least one fan. Wall 92 in housing 70, together with the 26 passive heat removal or exchanging system 12 and the thermoelectric assembly 46 prevents the air in and from enclosure 20 from mixing with the outside ambient air. The passive heat removal or exchanging system 12 is located in the upper portion of housing 70 with the thermoelectric devices 52 and heat exchanger 54 mounted in the lower portion of housing 70 and approximately in vertical alignment with the passive heat removal or exchanging system 12. In the preferred embodiment, heat exchanger 54 comprises an air-to-air heat exchanger with the usual finned array. It will be appreciated that the passive air-to-air heat exchanger may be formed by the extrusion process or the folding process of a heat conducting material. It will be appreciated that heat exchanger 54 extends through wall 92 with a predetermined portion of the unit being positioned on either side of wall 92 but mounted to prevent any air from passing from one side of wall 92 to the other side of wall 92. Depending upon the size of the passive air-to-air heat exchanger, wall 92 may exist as a wall only for the thermoelectric assembly 46 and exist as a mounting bracket for the passive heat removal or exchanging system 12, while still preventing the air in and from enclosure 20 from mixing with the outside ambient air. Power control system 30 is positioned above fan assembly 42. Baffles 94 and 96 together with wall 92 assist in directing the flow of air on both sides of wall 92.

It will be appreciated that the positions of the passive heat removal or exchanging system 12 and the thermoelectric devices 52 and heat exchanger 54 may be interchanged such that the thermoelectric devices 52 and heat exchanger 54 are mounted in the upper portion of housing 70 with the passive heat removal or exchanging system 12 mounted in the lower portion of housing 70 without departing from the spirit and scope of the present invention.

With reference to FIGS. 1–3, the operation of the present invention will be discussed. Upon activation of the heat producing equipment 18 and the thermoelectric temperature control system 14 by the electrical power source, the temperature sensor 36 begins to monitor the temperature within enclosure 20. When the signal to the power control system 30, from the temperature sensor 36, indicates that the temperature of the air within enclosure 20 has reached a first predetermined value, the microprocessor and software in the power control system 30 will cause the power control system 30 to activate fan assembly 38. The warm or heated air 16 will be drawn from enclosure 20, through openings 74 and 76, passed over that portion of the heat exchanger of passive heat removal or exchanging system 12 which resides on the enclosure 20 side of wall 92, passed over half of heat exchanger 54 of thermoelectric assembly 46 and then will be discharged back into enclosure 20 through openings 82 and 80. It will be appreciated that during the flow of the warm or heated air 16 some of the heat therein will be transferred to that portion of the heat exchanger of passive heat removal or exchanging system 12 which resides on the enclosure 20 side of wall 92 and then be transferred to that portion of the heat exchanger of passive heat removal system 12 which resides on the outside-air side of wall 92.

If the temperature of the warm or heated air 16 continues to increase, the signal from the temperature sensor 36 will indicate that the temperature of the air within enclosure 20 has reached a second predetermined value, and the power control system 30 will activate fan assembly 42. Fan assembly 42 will draw outside ambient air, through opening 86, which will be passed over that portion of the heat exchanger of passive heat removal or exchanging system 12 which resides on the outside-air side of wall 92 removing heat from the passive heat removal system 12 and expelling the warmed ambient air to the outside through opening 84. Fan assembly 42 will also cause some outside ambient air to pass over that half of heat exchanger 54 which resides on the outside-air side of wall 92 and to be discharged to the outside through opening 88.

If the temperature of the warm or heated air 16 continues to increase, the signal from the temperature sensor 36 will indicate that the temperature of the air within enclosure 20 has reached a third predetermined value, and the power control system 30 will activate the thermoelectric devices 52 which will cool the half of heat exchanger 54 which resides on the enclosure 20 side of wall 92. The activation of the thermoelectric devices 52 will further cool the precooled air 22. The power control system 30 will activate the thermoelectric devices 52 in a cyclic manner to keep the air in enclosure 20 below the maximum allowed value. It will be appreciated that the power control system 30 may keep fan assembly 38 activated and running all the time depending upon the requirements of the operation and installation.

If the air in enclosure 20 becomes colder than a predetermined value as indicated by the signal from the temperature sensor 36 to the power control system 30, the power control system 30 will activate the polarity reversal circuit 50. This application of a polarity reversed voltage to the thermoelectric devices 52 will result in the heating of the half of heat exchanger 54 which resides on the enclosure 20 side of wall 92 which results in the air in enclosure 20 being heated above a predetermined value. It will be appreciated that either or both fan assembly 38 and fan assembly 42 may be activated, if necessary.

From the foregoing detailed description, it can be appreciated that the present invention is capable of conditioning the air in an enclosure which shelters heat producing equipment by precooling the air by employing a low cost passive heat removal system to remove heat in conjunction with a thermoelectric temperature control system which achieves the necessary temperature control. The method of precooling the air using a passive heat removal system reduces the need for a large number of thermoelectric devices thus reducing the cost of such systems while making them energy efficient.

While particular embodiments of the present invention have been described, it will be appreciated by those skilled in the art that various modifications, alternatives, variations, etc., may be made without departing from the spirit and scope of the invention as defined in the appended claims.

What is claimed is:

1. A system for conditioning air within an enclosure containing heat producing equipment which is activated by an electrical power source, said system comprising:

a passive heat removal system for receiving the air from the enclosure containing heat producing equipment cooling the air by transferring heat from the air to outside of the enclosure, and outputting the cooled air therefrom;

at least one thermoelectric assembly for receiving the cooled air from the passive heat removal system, for further cooling the cooled air from the passive heat removal system upon being activated by transferring heat from the cooled air to outside of the enclosure, and for returning the cooled air to the enclosure containing the heat producing equipment;

a power control system for receiving a temperature input indicative of the temperature of the air within the enclosure and for activating the at least one thermoelectric assembly when the temperature input indicates that the temperature of the air within the enclosure is above a predetermined value determined for the heat producing equipment; and sensor means to monitor the temperature of the air within the enclosure and connected to provide to the power control system the temperature input indicative of the temperature of the air within the enclosure.

2. The system as set forth in claim 1 further including means for moving the air within the enclosure.

3. The system as set forth in claim 2 wherein said means for moving the air comprises at least one fan.

4. The system as set forth in claim 3 wherein the activation of said at least one fan is controlled by said power control system.

5. The system as set forth in claim 1 further including means for moving the air outside the enclosure.

6. The system as set forth in claim 5 wherein said means for moving the air comprises at least one fan.

7. The system as set forth in claim 6 wherein the activation of said at least one fan is controlled by said power control system.

8. The system as set forth in claim 1 wherein said power control system comprises programmable control means to receive an output from said sensor means and provide an output to the power control system causing said power control system to activate said at least one thermoelectric assembly, said providing of the output to the power control system being determined by the difference between the sensed temperature of the air within the enclosure and the predetermined value of temperature determined for the heat producing equipment.

9. The system as set forth in claim 8 wherein said programmable control means comprises a microprocessor and associated software.

10. The system as set forth in claim 1 wherein said passive heat removal system comprises a heat exchanger.

11. The system as set forth in claim 10 wherein said heat exchanger is an air-to-air heat exchanger.

12. The system as set forth in claim 11 wherein said air-to-air heat exchanger is formed by extrusion of a heat conducting material.

13. The system as set forth in claim 11 wherein said air-to-air heat exchanger is formed by the folding process of a heat conducting material.

14. The system as set forth in claim 1 wherein said at least one thermoelectric assembly comprises at least one thermoelectric device positioned between two sides of a heat exchanger.

15. The system as set forth in claim 14 wherein said heat exchanger comprises an air-to-air heat exchanger.

16. The system as set forth in claim 1 wherein said power control system receives power from said electrical power source.

17. The system as set forth in claim 16 further including a battery for providing power to said power control system if said electrical power source fails.

18. The system as set forth in claim 17 wherein said battery is a 24 volt DC battery.

19. The system as set forth in claim 17 wherein said battery is a 48 volt DC battery.

20. The system as set forth in claim 17 further including a switching device operatively connected between said electrical power source and said power control system to apply battery power to said power control system when said electrical power source fails.

21. The system as set forth in claim 16 further including a polarity reversal circuit operatively connected between said power control system and said at least one thermoelectric assembly to reverse the heat pumping of said at least one thermoelectric assembly.

22. A method of conditioning air within an enclosure containing heat producing equipment which is activated by an electrical power source, said method comprising the steps of:

providing a passive heat removal system for receiving the air from the enclosure containing heat producing equipment cooling the air by transferring heat from the air to outside of the enclosure, and outputting the cooled air therefrom;

providing at least one thermoelectric assembly for receiving the cooled air from the passive heat removal system, for further cooling the cooled air from the passive heat removal system upon being activated by transferring heat from the cooled air to outside of the enclosure, and for returning the cooled air to the enclosure containing the heat producing equipment;

providing a sensor for determining the temperature of the air within the enclosure and generating an indication of the temperature of the air within the enclosure;

providing a power control system to receive the indication of said temperature of the air within the enclosure and for activating the at least one thermoelectric assembly to maintain the temperature of the air within the enclosure below a predetermined value determined for the heat producing equipment.

23. The method as set forth in claim 22 further including the step of providing means for moving the air within the enclosure.

24. The method as set forth in claim 23 wherein said means for moving the air comprises at least one fan.

25. The method as set forth in claim 24 wherein the activation of said at least one fan is controlled by said power control system.

26. The method as set forth in claim 22 further including the step of providing the means for moving the air outside the enclosure.

27. The method as set forth in claim 26 wherein said means for moving the air comprises at least one fan.

28. The method as set forth in claim 27 wherein the activation of said at least one fan is controlled by said power control system.

29. The method as set forth in claim 22 wherein said power control system comprises programmable control means to receive the indication of said temperature of the air within the enclosure and provide an output to the power control system causing said power control system to activate said at least one thermoelectric assembly, said providing of the output to the power control system being determined by the difference between the determined temperature of the air within the enclosure and the predetermined value of temperature determined for the heat producing equipment.

30. The method as set forth in claim 29 wherein said programmable control means comprises a microprocessor and associated software.

31. The method as set forth in claim 22 wherein said passive heat removal system comprises a heat exchanger.

32. The method as set forth in claim 31 wherein said heat exchanger is an air-to-air heat exchanger.

33. The method as set forth in claim 32 wherein said air-to-air heat exchanger is formed by extrusion of a heat conducting material.

34. The method as set forth in claim 32 wherein said air-to-air heat exchanger is formed by the folding process of the heat conducting material.

35. The method as set forth in claim 22 wherein said at least one thermoelectric assembly comprises at least one thermoelectric device positioned between two sides of a heat exchanger.

36. The method as set forth in claim 35 wherein said heat exchanger comprises an air-to-air heat exchanger.

37. The method as set forth in claim 22 wherein said power control system receives power from said electrical power source.

38. The method as set forth in claim 37 further including the step of providing a battery for providing power to said power control system if said electrical power source fails.

39. The method as set forth in claim 38 wherein said battery is a 24 volt DC battery.

40. The method as set forth in claim 38 wherein said battery is a 48 volt DC battery.

41. The method as set forth in claim 38 further including the step of providing a switching device operatively connected between said electrical power source and said power control system to apply battery power to said power control system when said electrical power source fails.

42. The method as set forth in claim 37 further including the step of providing a polarity reversal circuit operatively connected between said power control system and said at least one thermoelectric assembly to reverse the heat pumping of said at least one thermoelectric assembly.

* * * * *

UNITED STATES PATENT AND TRADEMARK OFFICE

CERTIFICATE OF CORRECTION

PATENT NO : 6,058,712

DATED : May 9, 2000

INVENTOR(S) : Rajasubramanian et al.

It is certified that error appears in the above-identified patent and that said Letters Patent are hereby corrected as shown below:

Column 4, line 11 Replace "02/27196"
With --02/27/96--

Column 4, line 40 Replace "the 26 passive"
With --the passive--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*